US008989648B2

(12) United States Patent
Koyama

(10) Patent No.: US 8,989,648 B2
(45) Date of Patent: Mar. 24, 2015

(54) IMAGE RECORDING APPARATUS, RECORDING-MEDIA ALIGNING METHOD EXECUTED BY THE SAME, AND NON-TRANSITORY STORAGE MEDIUM STORING INSTRUCTIONS READABLE BY THE SAME

(71) Applicant: Keita Koyama, Nagoya (JP)

(72) Inventor: Keita Koyama, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/039,456

(22) Filed: Sep. 27, 2013

(65) Prior Publication Data

US 2014/0092160 A1 Apr. 3, 2014

(30) Foreign Application Priority Data

Sep. 28, 2012 (JP) ..... 2012-218404

(51) Int. Cl.
*G03G 15/00* (2006.01)
*B41J 13/00* (2006.01)
*B41J 13/10* (2006.01)

(52) U.S. Cl.
CPC ..... *B41J 13/0045* (2013.01); *B41J 13/106* (2013.01)
USPC ..... 399/367; 399/397; 270/32; 347/16

(58) Field of Classification Search
USPC ..... 399/367, 397; 270/32; 347/16
See application file for complete search history.

(56) References Cited

U.S. PATENT DOCUMENTS

2007/0182082 A1* 8/2007 Asami et al. ..... 270/32
2008/0205952 A1* 8/2008 Murai ..... 399/367
2008/0310899 A1* 12/2008 Yoo ..... 399/397
2012/0219338 A1* 8/2012 Watanabe et al. ..... 399/397

FOREIGN PATENT DOCUMENTS

JP 2012-126544 A 7/2012

* cited by examiner

*Primary Examiner* — Lam S Nguyen
(74) *Attorney, Agent, or Firm* — Scully, Scott, Murphy & Presser, P.C.

(57) ABSTRACT

An image recording apparatus includes: a recording unit for recording an image on a recording medium; a tray for supporting the recording medium recorded by the recording unit; a conveyor mechanism for conveying the recorded medium to the tray; and an alignment mechanism for aligning a plurality of recording media stacked on the tray, by application of an external force. In a period from a start to an end of recording based on one recording job, the alignment mechanism aligns the plurality of recording media stacked on the tray in a period in which image recording is not performed, and the alignment mechanism does not align the plurality of recording media stacked on the tray in a period in which image recording is being performed.

16 Claims, 8 Drawing Sheets

FIG.5

| NUMBER OF STACKED SHEETS | 0-100 | 100-200 | 300- |
|---|---|---|---|
| FIRST PREDETERMINED NUMBER | 50 | 30 | 20 |

IMAGE RECORDING APPARATUS, RECORDING-MEDIA ALIGNING METHOD EXECUTED BY THE SAME, AND NON-TRANSITORY STORAGE MEDIUM STORING INSTRUCTIONS READABLE BY THE SAME

CROSS REFERENCE TO RELATED APPLICATION

The present application claims priority from Japanese Patent Application No. 2012-218404, which was filed on Sep. 28, 2012, the disclosure of which is herein incorporated by reference in its entirety.

BACKGROUND OF THE INVENTION

1. Field of the Invention

The present invention relates to an image recording apparatus including a tray capable of supporting a plurality of recording media on which images have been respectively recorded, a method of aligning the plurality of recording media which is executed by a processor of the image recording apparatus, and a non-transitory storage medium storing a plurality of instructions readable by a computer of the image recording apparatus.

2. Description of the Related Art

There is conventionally known a technique of applying an external force to sheets stacked on a sheet-output tray to align the sheets. For example, there is known a sheet-discharge apparatus configured to discharge recording media in the form of sheets on which images are respectively formed or recorded, onto a sheet-output tray and align the sheets stacked on the sheet-output tray. In this sheet-discharge apparatus, trailing edges of the respective sheets stacked on the sheet-output tray are in abutment against a sheet-trailing-edge abutment fence. A vibration generator applies a vibration wave to the sheet-trailing-edge abutment fence to align the trailing edges of the respective sheets stacked on the sheet-output tray.

SUMMARY OF THE INVENTION

Incidentally, there is known an image recording apparatus including: a recording unit configured to record an image on a recording medium; and an output tray on which image-recorded recording media are discharged and stacked. In a case where the above-described sheet-discharge apparatus is applied to this image recording apparatus, when a vibration wave is applied to the sheet-trailing-edge abutment fence during image recording. This vibration wave may be transmitted to the recording unit, resulting in deterioration of a quality of an image recorded on the recording medium.

This invention has been developed to provide an image recording apparatus capable of aligning a plurality of recording media stacked on a tray while preventing deterioration of a quality of an image recorded on a recording medium, a method of aligning the plurality of recording media which is executed by a processor of the image recording apparatus, and a non-transitory storage medium storing a plurality of instructions readable by a computer of the image recording apparatus.

The present invention provides an image recording apparatus including: a recording unit configured to record an image on a recording medium; a storage configured to store a recording job containing image data representative of a plurality of images to be recorded on a plurality of recording media by the recording unit; a tray configured to support the recording medium on which an image has been recorded by the recording unit; a conveyor mechanism configured to convey, to the tray, the recording medium on which the image has been recorded by the recording unit; an alignment mechanism configured to align a plurality of recording media stacked on the tray, by application of an external force; a controller configured to control the recording unit, the conveyor mechanism, and the alignment mechanism, the controller being configured to control the recording unit to record the plurality of images respectively on a plurality of recording media based on the image data contained in the recording job stored in the storage, the controller being configured to control the conveyor mechanism to convey, to the tray, the plurality of recording media on which the plurality of images have been respectively recorded by the recording unit, in a period from a start to an end of recording based on one recording job, the controller being configured to control the alignment mechanism to align the plurality of recording media stacked on the tray in a period in which image recording is not performed by the recording unit and control the alignment mechanism not to align the plurality of recording media stacked on the tray in a period in which image recording is being performed by the recording unit.

The present invention also provides A method of aligning a plurality of recording media which is executed by a processor of an image recording apparatus, the image recording apparatus including: a recording unit configured to record an image on a recording medium; a storage configured to store a recording job containing image data representative of a plurality of images to be recorded on a plurality of recording media by the recording unit; a tray configured to support the recording medium on which an image has been recorded by the recording unit; a conveyor mechanism configured to convey, to the tray, the recording medium on which the image has been recorded by the recording unit; and an alignment mechanism configured to align a plurality of recording media stacked on the tray, by application of an external force, the method including: causing the recording unit to record the plurality of images respectively on a plurality of recording media based on the image data contained in the recording job stored in the storage; causing the conveyor mechanism to convey, to the tray, the plurality of recording media on which the plurality of images have been respectively recorded by the recording unit; and in a period from a start to an end of recording based on one recording job, causing the alignment mechanism to align the plurality of recording media stacked on the tray in a period in which image recording is not performed by the recording unit and controlling the alignment mechanism not to align the plurality of recording media stacked on the tray in a period in which image recording is being performed by the recording unit.

The present invention also provides A non-transitory storage medium storing a plurality of instructions readable by a computer of an image recording apparatus, the image recording apparatus including: a recording unit configured to record an image on a recording medium; a storage configured to store a recording job containing image data representative of a plurality of images to be recorded on a plurality of recording media by the recording unit; a tray configured to support the recording medium on which an image has been recorded by the recording unit; a conveyor mechanism configured to convey, to the tray, the recording medium on which the image has been recorded by the recording unit; and an alignment mechanism configured to align a plurality of recording media stacked on the tray, by application of an external force, the plurality of instructions, when executed by a processor of the image recording apparatus, causing the image recording apparatus to perform: recording the plurality of images respectively on a plurality of recording media based on the image data contained in the recording job stored in the storage; conveying, to the tray, the plurality of recording media on which the plurality of images have been respectively recorded by the recording unit; and in a period from a start to an end of recording based on one recording job, aligning the plurality of recording media stacked on the tray in a period in which image recording is not performed by the recording unit and controlling the alignment mechanism not to align the plurality of recording media stacked on the tray in a period in which image recording is being performed by the recording unit.

BRIEF DESCRIPTION OF THE DRAWINGS

The objects, features, advantages, and technical and industrial significance of the present invention will be better understood by reading the following detailed description of one embodiment of the invention, when considered in connection with the accompanying drawings, in which:

FIG. 5 is a table contained in a first predetermined number determiner illustrated in FIG. 4B;

DETAILED DESCRIPTION OF THE EMBODIMENT

Hereinafter, there will be described one embodiment of the present invention by reference to the drawings.

Figure 1:
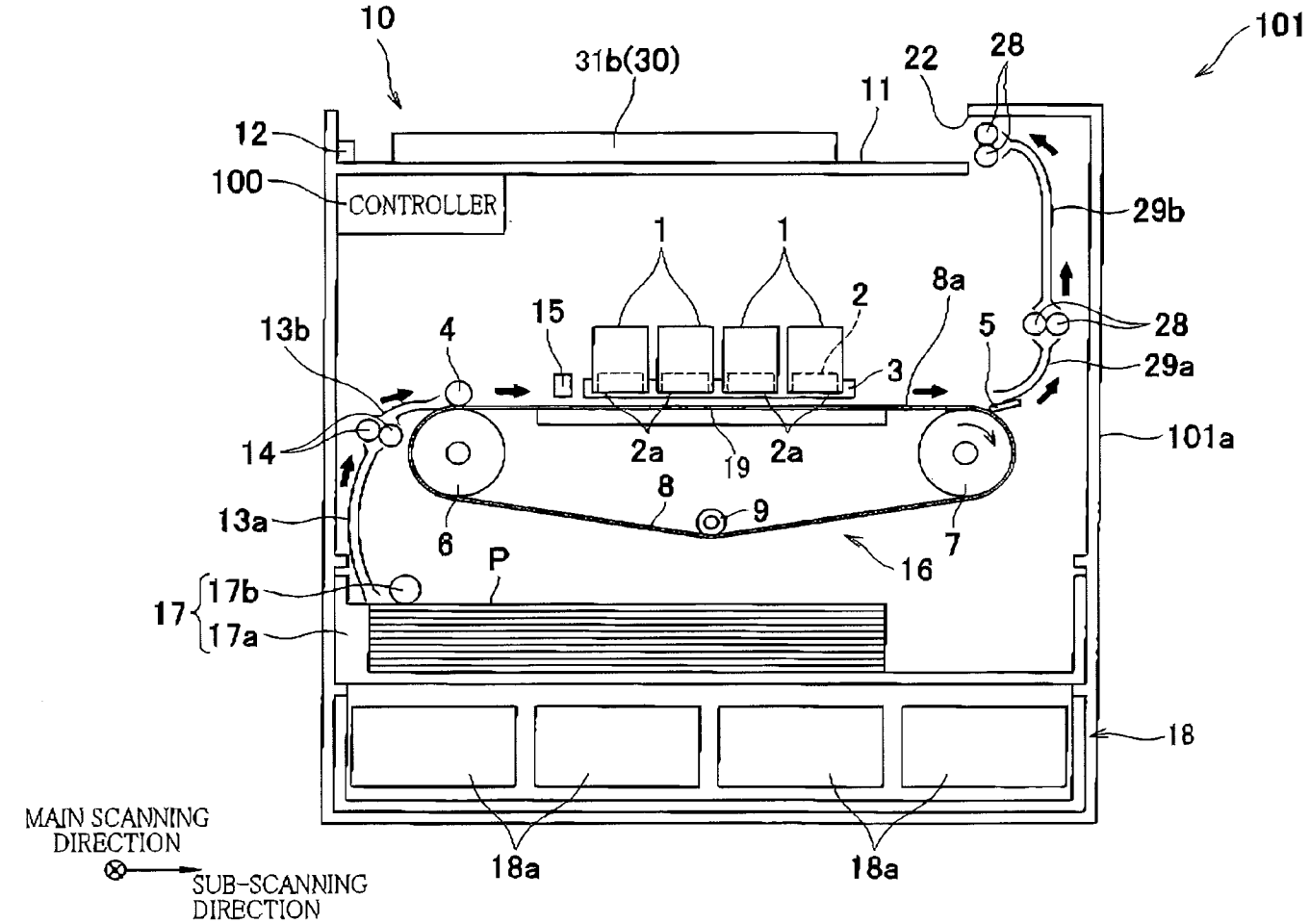
FIG. 1 is a schematic side view illustrating an overall structure of a printer according to one embodiment of the present invention.

As illustrated in FIG. 1, a printer 101 according to the present embodiment includes a housing 101*a* having generally a rectangular parallelepiped shape. The housing 101*a* contains from its upper side four recording heads 1, a conveyor mechanism 16, a sheet-supply unit 17, and a tank unit 18. The conveyor mechanism 16 is configured to convey a sheet P in a conveying direction that is a direction directed from the left side toward the right side in FIG. 1. The sheet-supply unit 17 is configured to supply the sheet P, and the tank unit 18 stores inks. A top of the housing 101*a* over the recording heads 1 includes a sheet-output portion 10 onto which the sheet P is discharged. The housing 101*a* further contains a controller 100 configured to control operations of the printer 101.

The four recording heads 1 are configured to respectively eject the inks of different four colors, namely, cyan, magenta, yellow, and black. Each of the recording heads 1 has generally a rectangular parallelepiped shape elongated in a main scanning direction. These recording heads 1 are fixed to a support frame 3 so as to be arranged in the conveying direction. That is, this printer 101 is a line printer, and accordingly the main scanning direction is a direction perpendicular to the conveying direction. Each of the recording heads 1 includes a head main body 2 whose lower face serves as an ejection face 2*a* having a multiplicity of ejection openings, not shown, formed therein.

The conveyor mechanism 16 includes two belt rollers 6, 7, a conveyor belt 8, a tension roller 9, and a platen 19. The conveyor belt 8 is an endless belt looped over the rollers 6, 7 and tensioned by the tension roller 9. The platen 19 is disposed in the conveyor belt 8 to support the conveyor belt 8 at a position opposite the recording heads 1. The belt roller 7 is a drive roller that is rotated by a motor, not shown. When the conveyor mechanism 16 drives the belt roller 7, the conveyor belt 8 is moved to convey the sheet P placed on a conveyor surface 8*a* of the conveyor belt 8. Also, the conveyor mechanism 16 is provided with a sheet sensor 15 for sensing the presence of the sheet P in a conveyance path. This sheet sensor 15 is provided mainly for sensing a leading edge of the sheet P being conveyed by the conveyor mechanism 16, i.e., a downstream edge of the sheet P in the conveying direction in order for the recording heads 1 to eject the inks at appropriate timings. In addition, the sheet sensor can sense a jam of the sheet P at an area opposite the ejection faces 2*a* of the respective recording heads 1 by comparing, with a predetermined length of time, a length of time elapsed from a timing when the sheet sensor 15 senses the leading edge of the sheet P, i.e., the downstream edge of the sheet P in the conveying direction, to a timing when the sheet sensor 15 senses a trailing edge of the sheet P, i.e., an upstream edge of the sheet P in the conveying direction. When this length of time is longer than the predetermined length of time, the controller 100 determines that the jam of the sheet P has occurred.

The sheet-supply unit 17 is removably installed in the housing 101*a* and includes: a sheet-supply tray 17*a* configured to accommodate a plurality of sheets P; and a sheet-supply roller 17*b* rotatable to supply an uppermost one of the plurality of sheets P stacked on the sheet-supply tray 17*a*. The sheet P supplied from the sheet-supply tray 17*a* is conveyed to the conveyor mechanism 16 by a conveyor roller pair 14 along guides 13*a*, 13*b*.

The tank unit 18 contains four ink tanks 18*a*. The ink tanks 18*a* are removably mounted in the tank unit 18. The ink tanks 18*a* respectively store the inks of the cyan, magenta, yellow, and black, which are respectively supplied to the recording heads 1 through ink tubes, not shown.

As illustrated in FIG. 1, the conveyance path extending along the black arrows is formed in the printer 101. The sheet P fed from the sheet-supply unit 17 to the conveyor mechanism 16 is pressed against the conveyor surface 8*a* by a pressure roller 4. When the sheet P passes through the area opposite the ejection faces 2*a* of the respective recording heads 1, a desired color image is formed on an upper side of the sheet P. The sheet on which the image has been formed is peeled from the conveyor surface 8*a* by a peeling member 5 disposed just downstream of the conveyor mechanism 16. The sheet P is then conveyed upward along guides 29*a*, 29*b* by a conveyor roller pair 28 and discharged onto the sheet-output portion 10 through an output opening 22 formed in an upper portion of the housing 101*a*.

The sheet-output portion 10 includes: an output tray 11 on which the sheets P discharged from the output opening 22 are stacked; and an alignment mechanism 30 configured to jog and align the sheets P stacked on the output tray 11. The output tray 11 is provided with a number-of-stacked-sheets obtaining sensor 12 that is an optical sensor configured to obtain the number of sheets P stacked on the output tray 11.

Figure 2:
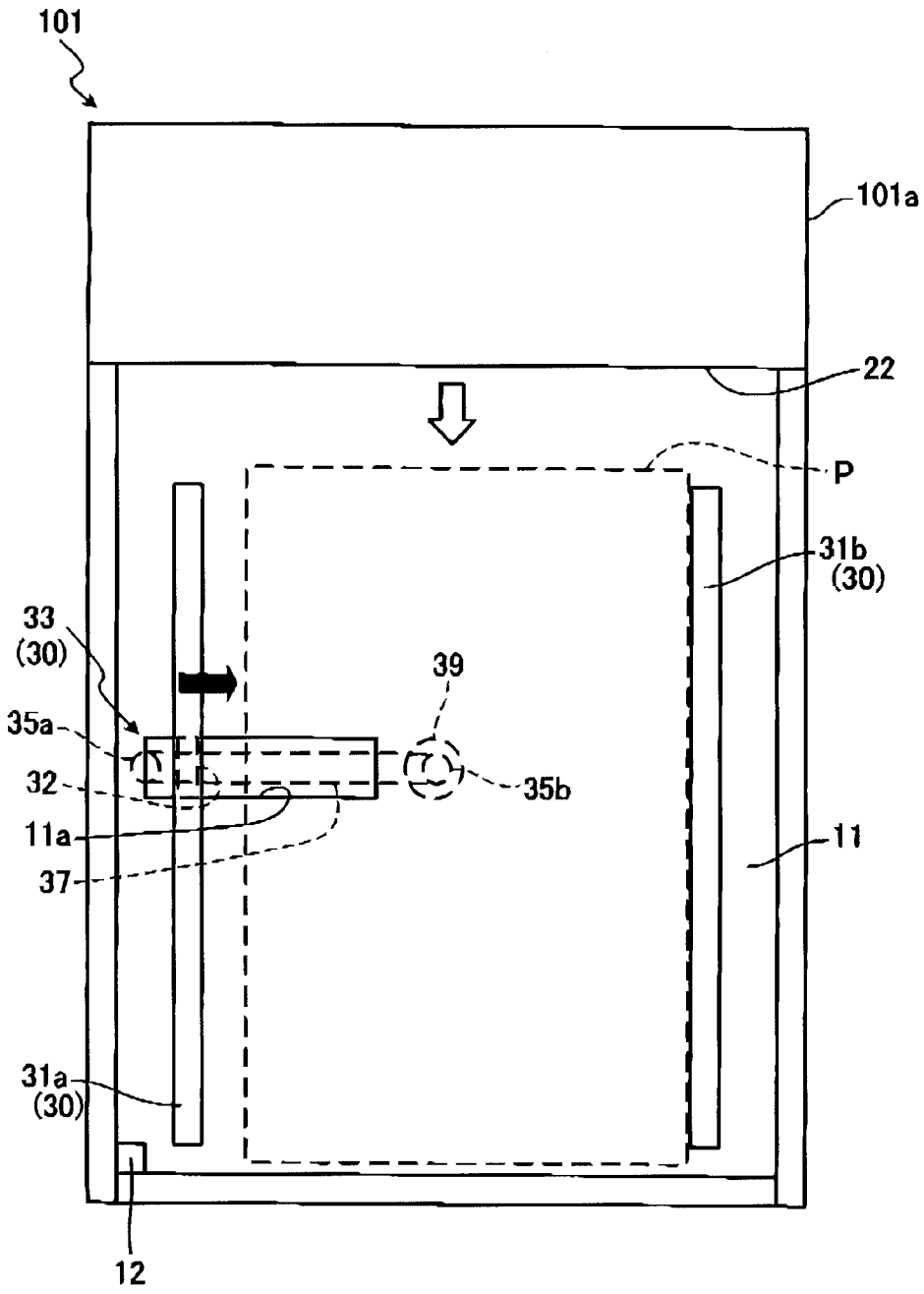
FIG. 2 is a top view illustrating the printer illustrated in FIG. 1.

As illustrated in FIG. 2, the alignment mechanism 30 includes a pair of limiting walls arranged parallel to each other on the output tray 11, and the pair of limiting walls is constituted by a left limiting wall 31*a* and a right limiting wall 31*b* in FIG. 2. The alignment mechanism 30 further includes a limiting-wall displacement mechanism 33 configured to displace or move the left limiting wall 31*a* with respect to the right limiting wall 31*b*. Each of the limiting walls 31*a*, 31*b* is a plate member that extends in a direction in which the sheet P is discharged from the output opening 22, i.e., in a direction indicated by the white arrow in FIG. 2. The limiting walls 31*a*, 31*b* limit or constrain opposite edge portions of the sheets P stacked on the output tray 11 in their widthwise direction, A left portion of the output tray 11 has a guide groove 11*a* extending in the widthwise direction of the sheet P. Fitted in the guide groove is a support portion 32 for supporting a lower end portion of the limiting wall 31*a*.

The limiting-wall displacement mechanism 33 includes: a pair of pulleys 35*a*, 35*b* spaced apart from each other in the widthwise direction of the sheet P; a driving belt 37 looped over the pulleys 35*a*, 35*b*; and a motor 39 for rotating the pulley 35*b*. The support portion 32 supporting the limiting wall 31*a* is holding the driving belt 37, so that the limiting wall 31*a* is moved together with the driving belt 37. Thus, when the motor 39 rotates the driving belt 37, the limiting wall 31*a* is moved along the guide groove 11*a* in the widthwise direction of the sheet P. That is, the limiting wall 31*a* can be moved toward or away from the limiting wall 31*b* depending upon a direction of rotation of the motor 39 to change a distance between the limiting walls 31*a*, 31*b*. Thus, when the sheets P are aligned, the limiting wall 31*a* is moved toward the limiting wall 31*b* as indicated by the black arrow in FIG. 2, and an external force is applied to the sheets P such that right edges of the sheets P stacked on the output tray 11 in FIG. 2 are pressed against the limiting wall 31*b*.

Figure 3:
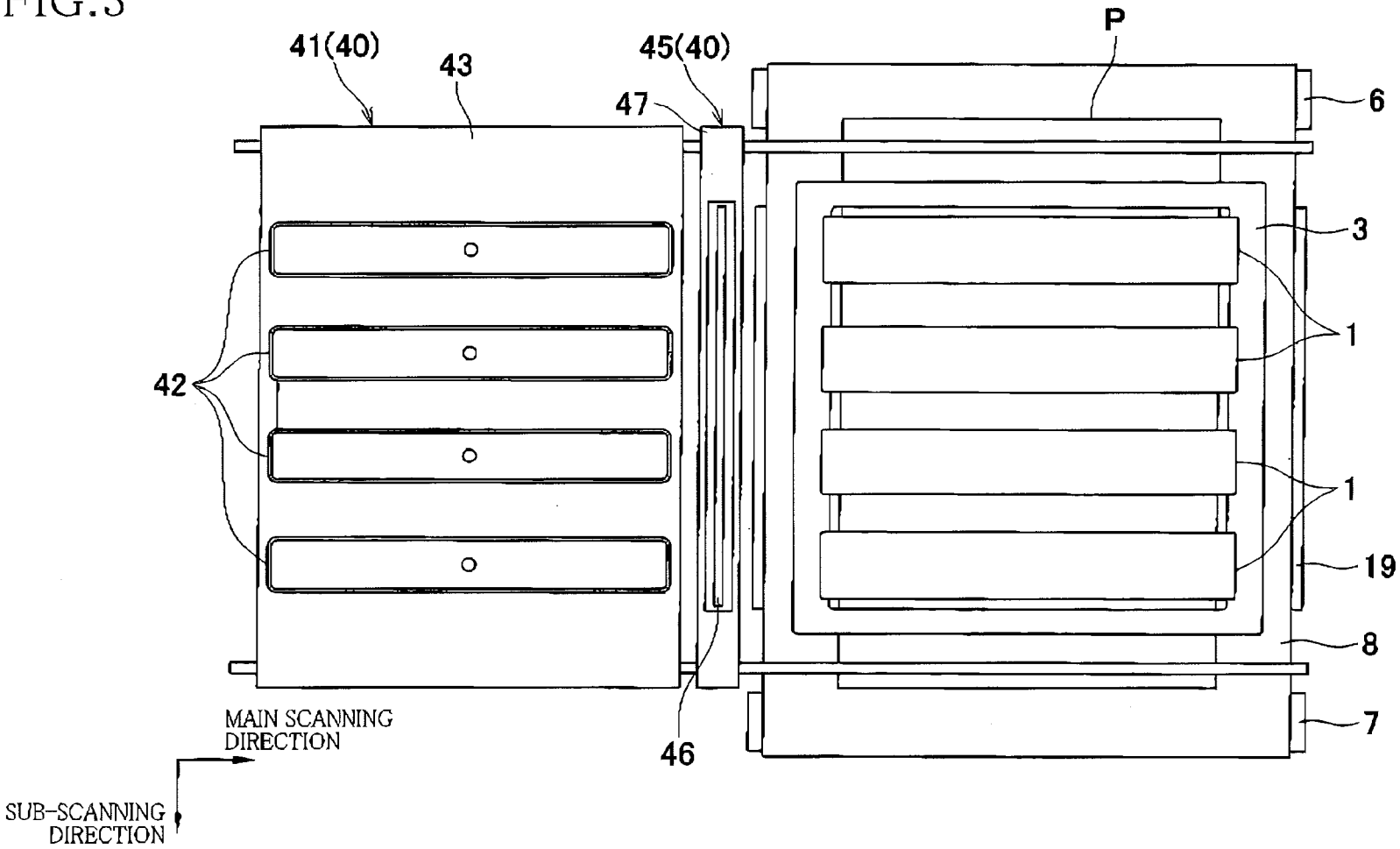
FIG. 3 is a top view illustrating a portion of the printer illustrated in FIG. 1.

The printer 101 further includes a maintenance mechanism 40 configured to perform maintenance on the recording heads 1. As illustrated in FIG. 3, when the maintenance is not performed, the maintenance mechanism 40 is located on a side of the recording heads 1 in the main scanning direction, specifically, the maintenance mechanism 40 is located at the left of the recording heads 1 in FIG. 3. The maintenance mechanism 40 includes a cap unit 41 and a wiping unit 45.

The cap unit 41 is mounted on a support plate 43 that is movable in the main scanning direction. The cap unit 41 includes four purging caps 42 that face the respective recording heads 1 when the support plate 43 is moved to a position opposite the recording heads 1. The recording heads 1 are lowered by an elevating and lowering mechanism, not shown, in a state in which the four purging caps 42 face the respective recording heads 1, so that the four purging caps 42 respectively cover the ejection faces 2*a* of the respective recording heads 1. A pressure pump, not shown, is provided between the recording heads 1 and the ink tanks 18*a*. When this pressure pump is driven in the state in which the ejection faces 2*a* of the respective recording heads 1 are covered with the respective purging caps 42, high-viscosity inks and foreign matters in the recording heads 1 are forcibly discharged from the ejection openings of the recording heads 1 (noted that this operation may be hereinafter referred to as "pressure purging"). Also, the purging caps 42 communicate with a waste-ink tank, not shown, such that the inks and the foreign matters discharged are stored in the waste-ink tank.

The wiping unit 45 is disposed at the right of the cap unit 41 in FIG. 3 and includes a wiper 46 mounted on a support plate 47 that is movable in the main scanning direction. When the recording heads 1 are lowered by an elevating and lowering mechanism, not shown, in a state in which the wiper 46 is located at a position opposite the recording heads 1, a distal end portion of the wiper 46 is brought into contact with the ejection faces 2*a* of the respective recording heads 1. When the support plate 47 is moved in the main scanning direction in this state, the wiper 46 wipes the ejection face 2*a*. The maintenance mechanism 40 performs this wiping after the pressure purging.

Figure 4A:
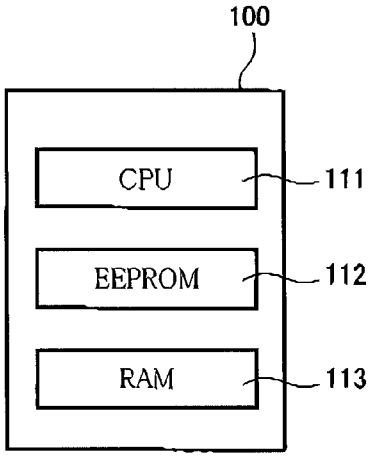
FIG. 4A is a block diagram illustrating a configuration of a controller illustrated in FIG. 1.

As illustrated in FIG. 4A, the controller 100 includes: a central processing unit (CPU) 111; an electrically erasable and programmable read only memory (EEPROM) 112 configured to rewritably store programs executable by the CPU 111 and data used for the programs; and a random access memory (RAM) 113 configured to temporarily store data upon execution of the programs. Upon execution by the CPU 111, a control program in the present invention provides various functional portions of the controller 100 which are illustrated in FIG. 4B.

Figure 4B:
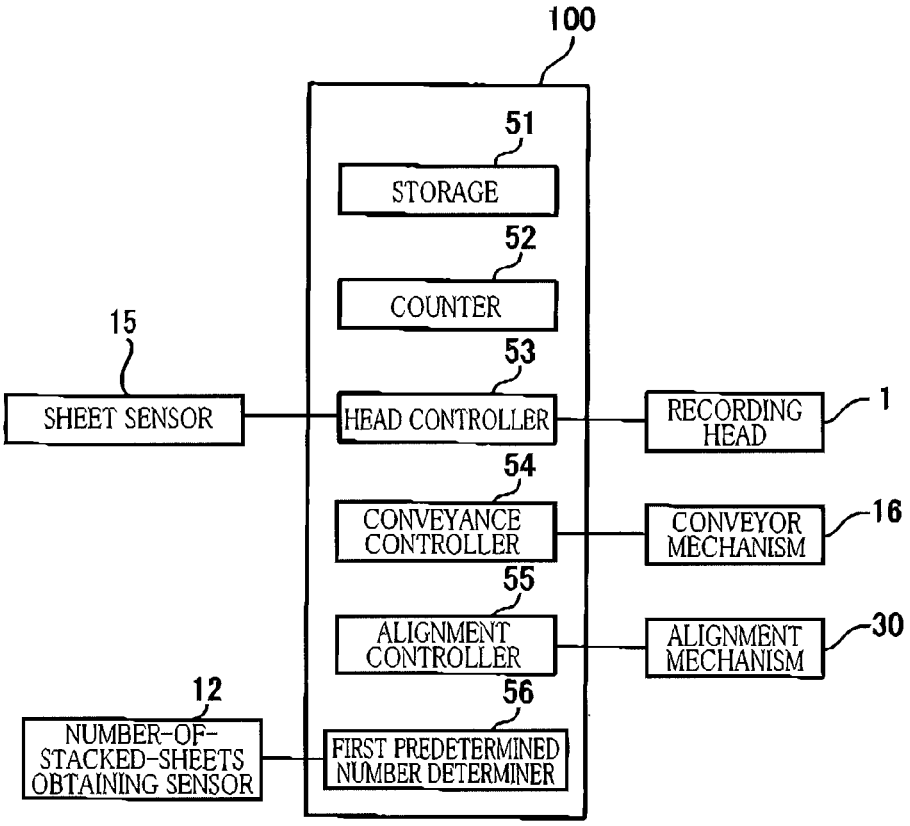
FIG. 4B is a block diagram illustrating functional portions of the controller.

As illustrated in FIG. 4B, the controller 100 includes a storage 51, a counter 52, a head controller 53, a conveyance controller 54, an alignment controller 55, and a first predetermined number determiner 56.

The storage 51 stores one recording job containing a plurality of sets of image data respectively representative of a plurality of images. The one recording job is transferred from a device coupled to the printer 101 such as a personal computer (PC) to the storage 51. In a period from a start to an end of recording based on the one recording job, the counter 52 is configured to count the number of recorded sheets N which is the number of sheets P for which image recording is completed after the preceding alignment of the sheets P stacked on the output tray 11 is performed by the alignment mechanism 30.

The head controller 53 controls the recording heads 1 such that a plurality of images respectively based on a plurality of sets of image data contained in the recording job stored in the storage 51 (hereinafter may be simply referred to as "the plurality of images") are respectively recorded on a plurality of sheets P. This printer 101 includes a normal image quality mode and a high image quality mode each as an image quality mode, and a higher quality image is recorded on the sheet P in the high image quality mode than in the normal image quality mode. The head controller 53 can select one of the normal image quality mode and the high image quality mode each as the image quality mode. Also, in the period of the recording based on the one recording job, the head controller 53 interrupts the recording of the image on the sheet P when the number of recorded sheets N which is counted by the counter 52 has reached a first predetermined number determined by the first predetermined number determiner 56. That is, after the plurality of images for the recording job start to be recorded on the respective sheets P by the recording heads 1, when recording on an Nth sheet P is finished, the head controller 53 interrupts recording on an N+1th sheet P. However, in a case where the number of sheets P to be recorded after the preceding alignment of the sheets P by the alignment mechanism 30 in the period of the recording based on the one recording job is larger than the first predetermined number and smaller than a second predetermined number (larger than the first predetermined number), the head controller 53 does not interrupt the recording of the image on the sheet P even when the number of recorded sheets N has reached the first predetermined number. The conveyance controller 54 controls the conveyor mechanism 16 to convey, to the output tray 11, the plurality of sheets P on which the plurality of images are respectively recorded by the recording heads 1.

In the period of the recording based on the one recording job, the alignment controller 55 controls the alignment mechanism 30 to align the sheets P stacked on the output tray 11 in a period in which the image recording is not being performed on the sheet P by the recording heads 1 (noted that this period includes a period in which the recording is interrupted) and controls the alignment mechanism 30 not to align the sheets P stacked on the output tray 11 in a period in which the image recording is being performed on the sheet P by the recording heads 1.

Also, the alignment controller 55 controls the alignment mechanism 30 to align the sheets P stacked on the output tray 11 when the number of recorded sheets N counted by the counter 52 has reached the first predetermined number determined by the first predetermined number determiner. However, in the case where the number of sheets P to be recorded after the preceding alignment of the sheets P by the alignment mechanism 30 in the period of the recording based on the one recording job is larger than the first predetermined number and smaller than the second predetermined number, the sheets P are not aligned even when the number of recorded sheets N has reached the first predetermined number. In the case where the plurality of images have been recorded on the respective sheets P by the recording heads 1, the sheets P are aligned. In the present embodiment, the second predetermined number is a number that is obtained by adding five to the first predetermined number.

Also, the alignment controller 55 controls the alignment mechanism 30 not to align the sheets P in an interruption period in which the recording of the image on the sheet P by the recording heads 1 is interrupted owing to a first event, and the alignment controller 55 controls the alignment mechanism 30 to align the sheets P in an interruption period in which the recording of the image on the sheet P is interrupted owing to a second event that differs from the first event. Here, examples of the first event in the present embodiment include: a case where lowered performance of the recording heads 1 for ink ejection has created a need to cause the maintenance mechanism 40 to perform the maintenance on the recording heads 1; and a case where the sheet sensor 15 has sensed the jam of the sheet P at the area opposite the ejection faces 2*a* of the respective recording heads 1. Examples of the second event include: a case where the printer 101 runs out of sheet or ink; a case where a recorded sheet P needs to be dried; and a case where the number of sheets P stacked on the output tray 11 has reached a predetermined number, in other words, the output tray 11 becomes full.

In the case where the image quality mode is the high image quality mode, the alignment controller 55 controls the alignment mechanism 30 not to align the sheets P when the conveyor mechanism 16 is conveying the sheet P printed by the recording heads 1 to the output tray 11, and the alignment controller 55 controls the alignment mechanism 30 to align the sheets P when the conveyor mechanism 16 is not conveying the sheet P printed by the recording heads 1 to the output tray 11.

The first predetermined number determiner 56 is configured to determine the first predetermined number based on the number of sheets P stacked on the output tray 11 which is obtained by the number-of-stacked-sheets obtaining sensor 12 when the preceding alignment of the sheets P stacked on the output tray 11 is performed by the alignment mechanism 30. That is, the first predetermined number determiner 56 has a table as illustrated in FIG. 5 in which the first predetermined number and the number of sheets P stacked on the output tray 11 are associated with each other. As illustrated in FIG. 5, the larger the number of sheets P stacked on the output tray 11, the smaller the first predetermined number is.

Figure 6:
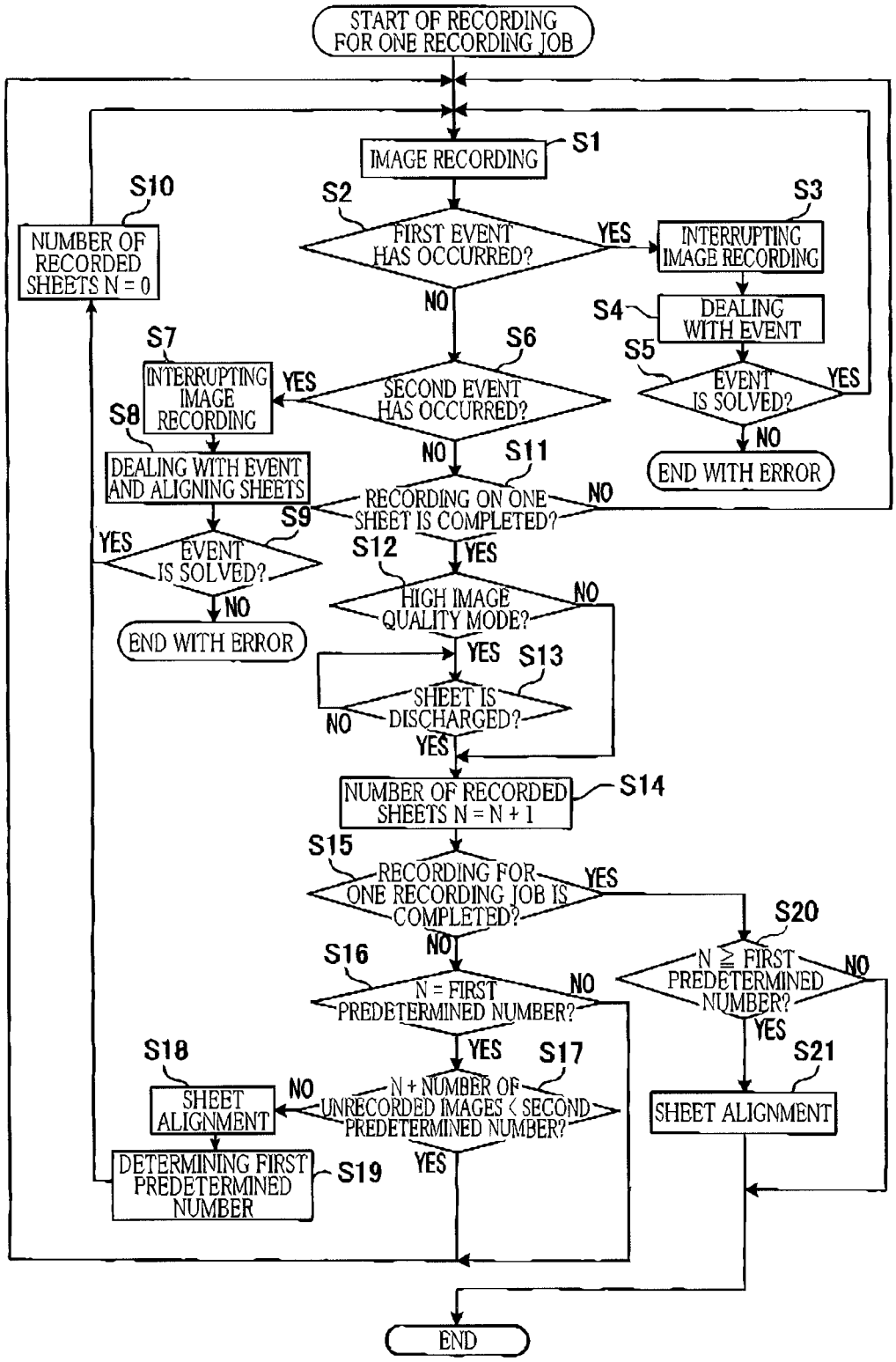
FIG. 6 is a flow chart illustrating one example of a procedure of processings executable by the controller illustrated in FIG. 1.

There will be next explained, with reference to FIG. 6, one example of a procedure of processings that are executed by the controller 100 when the printer 101 records a plurality of images respectively on a plurality of sheets P based on a plurality of sets of image data contained in one recording job. It is noted that, at the start of this flow, the first predetermined number is set at 50 based on the table illustrated in FIG. 5.

This flow begins with S1 at which the head controller 53 controls the recording heads 1 to start recording one of the plurality of images respectively based on the plurality of sets of image data stored in the storage 51, on a sheet P in the normal image quality mode or the high image quality mode. At S2, the alignment controller 55 determines whether the first event has occurred or not.

When the first event has occurred (S2: YES), the head controller 53 at S3 interrupts the image recording by the recording heads 1. At S4, the controller 100 controls the maintenance mechanism 40 to perform the maintenance on the recording heads 1 or executes a processing for a user to clear the jam of the sheet P. The controller at S5 determines whether the event has been solved or not. When the event has been solved (S5: YES), this flow returns to S1, and the recording heads 1 restart the image recording. On the other hand, when the event has not been solved (S5: NO), this flow ends with an error.

On the other hand, when the first event has not occurred (S2: NO), the controller 100 at S6 determines whether the second event has occurred or not. When the second event has occurred (S6: YES), the head controller 53 at S7 interrupts the image recording by the recording heads 1. The controller 100 at S8 executes a processing for the user to replenish sheets or ink, for example, and at the same time the alignment controller 55 controls the alignment mechanism 30 to align the sheets P stacked on the output tray 11. The controller 100 at S9 determines whether the event has been solved or not. When the event has been solved (S9: YES), the counter 52 at S10 resets the number of recorded sheets N (N=0). This flow then returns to S1, and the recording heads 1 restart the image recording. On the other hand, when the event has not been solved (S9: NO), this flow ends with an error.

When the second event has not occurred (S6: NO), the controller 100 at S11 determines whether the recording of the image on the one sheet P has been completed or not. When the recording of the image on the one sheet P is not completed (S11: NO), this flow returns to S1 at which the recording heads 1 continue to record the image. When the recording of the image on the one sheet P is completed (S11: YES), the controller 100 at 812 determines whether the image quality mode selected by the head controller 53 is the high image quality mode or not.

When the image quality mode is not the high image quality mode (S12: NO), this flow goes to S14. On the other hand, when the image quality mode is the high image quality mode (S12: YES), the controller 100 at S13 determines whether the sheet P for which the image had been recorded has been discharged onto the output tray 11 or not, that is, the controller 100 determines whether the conveyance of the sheet to the output tray 11 has been completed or not. The determination at S13 is repeated until the conveyance of the sheet to the output tray 11 is completed. That is, this flow does not go to S14 until the conveyance of the sheet to the output tray 11 is completed.

The counter 52 at S14 increments the number of recorded sheets N by one. The controller 100 at S15 determines whether or not the recording heads 1 have recorded all the images based on the plurality of sets of image data contained in the one recording job. When all the images have not been recorded (S15; NO), the controller 100 at S16 determines whether the number of recorded sheets N is equal to the first predetermined number or not. When the number of recorded sheets N is not equal to the first predetermined number (S16: NO), this flow returns to S1 at which the recording heads 1 start recording the next image.

On the other hand, when the number of recorded sheets N is equal to the first predetermined number (S16: YES), the controller 100 at S17 determines whether or not the number obtained by adding the number of unrecorded images among the plurality of images based on the plurality of sets of image data contained in the one recording job stored in the storage 51, to the number of recorded sheets N (i.e., the first predetermined number) is smaller than the second predetermined number. When the number obtained by adding the number of unrecorded images to the first predetermined number is smaller than the second predetermined number, that is, when the number of sheets P to be recorded after the preceding alignment of the sheets P in the period of the recording based on the one recording job is smaller than the second predetermined number (S17: YES), this flow returns to S1 at which the recording heads 1 start recording the next image.

On the other hand, when the number obtained by adding the number of unrecorded images to the first predetermined number is equal to or larger than the second predetermined number (S17; NO), the alignment controller 55 at S18 controls the alignment mechanism 30 to align the sheets P stacked on the output tray 11. It is noted that the image is not recorded by the recording heads 1 throughout this alignment. The first predetermined number determiner 56 at S19 determines the first predetermined number based on the table illustrated in FIG. 5 and the number of sheets P stacked on the output tray 11 which is obtained by the number-of-stacked-sheets obtaining sensor 12. Then, the counter 52 at S10 resets the number of recorded sheets N (N=0)

When all the images have been recorded (S15: YES), the controller at S20 determines whether or not the number of recorded sheets N is equal to or larger than the first predetermined number. When the number of recorded sheets N is equal to or larger than the first predetermined number (S20: YES), the alignment controller 55 at S21 controls the alignment mechanism 30 to align the sheets P stacked on the output tray 11, and this flow ends. On the other hand, when the number of recorded sheets N is smaller than the first predetermined number (S20: NO), this flow ends.

In the present embodiment described above, the printer 101 includes the alignment mechanism 30 configured to apply an external force to the sheets P stacked on the output tray 11 to jog and align the sheets P stacked on the output tray 11. In the period from the start to the end of the recording of the plurality of images by the recording heads 1 based on the image data contained in the one recording job, the alignment controller 55 controls the alignment mechanism 30 to align the sheets P stacked on the output tray 11 in the period in which the image recording is not being performed on the sheet P by the recording heads 1 and controls the alignment mechanism 30 not to align the sheets P stacked on the output tray 11 in a period in which the image recording is being performed on the sheet P by the recording heads 1. This configuration makes it possible to align the sheets P stacked on the output tray 11 while preventing that vibrations generated during the alignment performed by the alignment mechanism 30 deteriorate the quality of the image recorded on the sheet P.

In the printer 101 according to the present embodiment, when the number of sheets P conveyed to the output tray 11 by the conveyor mechanism 16 after the preceding alignment of the sheets P stacked on the output tray 11 has reached the first predetermined number, the recording of the image on the sheet P is interrupted to align the sheets P stacked on the output tray 11. Accordingly, the sheets P stacked on the output tray 11 can be aligned each time when the first predetermined number of the sheets P have been conveyed to the output tray 11.

In the printer 101 according to the present embodiment, in the case where the number of sheets P to be recorded after the preceding alignment of the sheets P by the alignment mechanism 30 in the period of the recording based on the one recording job is larger than the first predetermined number and smaller than the second predetermined number, the sheets P stacked on the output tray 11 are not aligned when the first predetermined number of the sheets P are conveyed to the output tray 11 by the conveyor mechanism 16, but the sheets P are aligned after the plurality of images have been recorded on the respective sheets P by the recording heads 1. Accordingly, even in a case where the first predetermined number of the sheets P have been conveyed to the output tray 11, when the recording of the plurality of images on the respective sheets P is close to completion, the completion of the recording of the plurality of images on the respective sheets P is given a higher priority, so that the recorded sheets P are stacked on the output tray 11 early. This configuration allows the user to selectively collect the sheets P from the output tray 11 before or after the alignment of the sheets P.

In the printer 101 according to the present embodiment, the sheets P stacked on the output tray 11 are aligned in the interruption period in which the recording of the image on the sheet P is interrupted owing to the second event. This configuration makes it possible to shorten a length of time required for the alignment or reduce the number of alignments of sheets P stacked on the output tray 11 after the interruption period.

In the printer 101 according to the present embodiment, when the maintenance mechanism 40 performs the maintenance on the recording heads 1, the sheets P stacked on the output tray 11 are not aligned in the maintenance. This configuration can prevent that the vibrations generated during the alignment performed by the alignment mechanism 30 cause a failure of the printer 101 due to, e.g., a collision between the maintenance mechanism 40 and the ejection faces 2*a* of the respective recording heads 1.

In the printer 101 according to the present embodiment, when the sheet sensor 15 has sensed the jam of the sheet P at the area opposite the ejection faces 2*a* of the respective recording heads 1, the sheets P stacked on the output tray 11 are not aligned. This configuration can prevent that the vibrations generated during the alignment performed by the alignment mechanism 30 cause a collision between the jammed sheet P and the ejection faces 2*a*.

In the printer 101 according to the present embodiment, the output tray 11 is provided above the height level of the recording heads 1. Since the vibrations generated during the alignment of the sheets P stacked on the output tray 11 do not deteriorate the quality of the image recorded on the sheet P in the present invention, the printer 101 can be made compact by providing the output tray 11 above the recording heads 1 as in the above-described construction.

In the printer 101 according to the present embodiment, in the case where the image quality mode is the high image quality mode, the sheets P are not aligned when the conveyor mechanism 16 is conveying the sheet P printed by the recording heads 1 to the output tray 11, and the sheets P are aligned when the conveyor mechanism 16 is not conveying the sheet P printed by the recording heads 1 to the output tray 11. This configuration can prevent that an image-recorded side of the sheet P being conveyed by the conveyor mechanism 16 comes into contact with components of the conveyor mechanism 16 in the high image quality mode, resulting in deterioration of the quality of the image recorded on the sheet P.

In the printer 101 according to the present embodiment, the larger the number of sheets P stacked on the output tray 11 which is obtained by the number-of-stacked-sheets obtaining sensor 12 when the preceding alignment of the sheets P stacked on the output tray 11 is performed by the alignment mechanism 30, the smaller the first predetermined number is determined. In other words, the sheets P are aligned at shorter intervals with increase in the number of sheets P stacked on the output tray 11. Accordingly, even if the number of sheets P stacked on the output tray 11 has been increased, the sheets P can be aligned reliably.

In the printer 101 according to the present embodiment, the alignment mechanism 30 includes: the pair of limiting walls 31*a*, 31*b* disposed parallel to each other to constrain the opposite edge portions of the sheets P stacked on the output tray 11; and the limiting-wall displacement mechanism 33 that can move the limiting wall 31*a* with respect to the limiting wall 31*b* to change the distance between the pair of limiting walls 31*a*, 31*b*. Accordingly, the limiting-wall displacement mechanism 33 can displace the limiting wall 31*a* with respect to the limiting wall 31*b* to align the opposite edge portions of the sheets P stacked on the output tray 11 in the widthwise direction.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

For example, the alignment mechanism 30 includes: the pair of limiting walls 31*a*, 31*b* disposed parallel to each other; and the limiting-wall displacement mechanism 33 that can move the limiting wall 31*a* with respect to the limiting wall 31*b* to change the distance between the pair of limiting walls 31*a*, 31*b* in the above-described embodiment, but the present invention is not limited to this configuration. That is, the limiting-wall displacement mechanism 33 may be configured to displace both of the limiting walls 31*a*, 31*b*.

Figure 7:
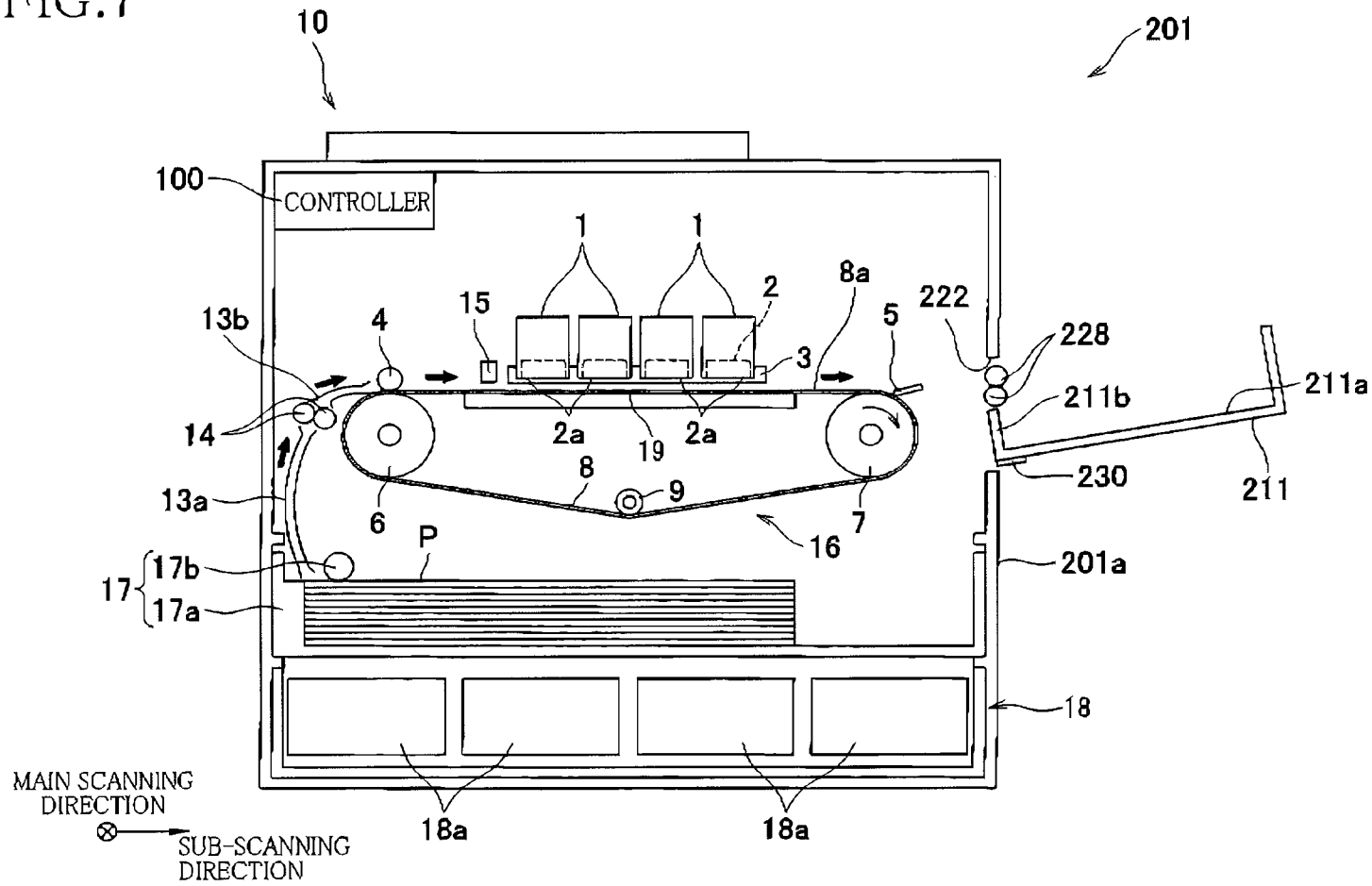
FIG. 7 is a schematic side view illustrating an overall structure of a printer according to a modification of the one embodiment of the present invention.

FIG. 7 illustrates a printer 201 as a modification of the above-described embodiment. This printer 201 includes a housing 201*a* having an output opening 222 formed in a side wall thereof. The side wall of the housing 101*a* is provided with an output tray 211 on which sheets P discharged from the output opening 222 by a conveyor roller pair 228 are stacked. The output tray 211 has a support face 211*a* that is inclined from a direction in which the sheets P are discharged from the output opening 222, such that an end portion of the support face 211*a* nearer to the output opening 222 is located at a position lower in height than an end portion of the support face 211*a* farther from the output opening 222. Thus, a side wall of the output tray 211 near the output opening 222 serves as an abutment member 211*b* with which one edges of the sheets P stacked on the output tray 211 come into contact. In the present modification, an alignment mechanism 230 configured to align the sheets P stacked on the output tray 211 is a vibrator for vibrating the output tray 211 such as a vibration motor. The alignment mechanism 230 vibrates the output tray 211 to apply an external force to the sheets P to align the one edges of the sheets P being in abutment against the abutment member 211*b*.

In the above-described embodiment, when the first predetermined number of the sheets P are conveyed to the output tray 11 after the preceding alignment of the sheets P, the recording of the image on the sheet P is interrupted to align the sheets P stacked on the output tray 11. In the case where the number of sheets P to be recorded after the preceding alignment of the sheets P by the alignment mechanism 30 in the period of the recording based on the one recording job is larger than the first predetermined number and smaller than the second predetermined number, the sheets P stacked on the output tray 11 are not aligned when the first predetermined number of the sheets P are conveyed to the output tray 11, but the sheets P are aligned after the plurality of images have been recorded on the respective sheets P by the recording heads 1. However, the present invention is not limited to this configuration. That is, even where the recording of the plurality of images on the respective sheets P is close to completion, the sheets P may or may not be aligned each time when the first predetermined number of the sheets P have been conveyed to the output tray 11.

While the second predetermined number is the number obtained by adding five to the first predetermined number in the above-described embodiment, the present invention is not limited to this configuration. That is, the second predetermined number may be a number obtained by adding any number or constant other than five to the first predetermined number. For example, the second predetermined number may be the number obtained by adding ten percent of the first predetermined number to the first predetermined number.

In the above-described embodiment, the sheets P are aligned in the interruption period in which the recording of the image on the sheet P is interrupted owing to the second event such as the case where the printer 101 runs out of sheet or ink. However, the sheets P may not be aligned when the second event has occurred.

In the above-described embodiment, the sheets P are not aligned in the interruption period in which the recording of the image on the sheet P is interrupted owing to the first event such as the case where the maintenance on the recording heads 1 is required and the case where the sheet jam has occurred. However, the sheets P may be aligned when the first event has occurred.

While the output tray 11 is provided on the top of the housing 101*a* in the above-described embodiment, the present invention is not limited to this construction. For example, as in the printer 201 according to the modification illustrated in FIG. 7, the output tray 211 may be disposed on a side of the housing 201*a*.

In the above-described embodiment, in the case where the image quality mode is the high image quality mode, the sheets P are not aligned when the recorded sheet P is being conveyed to the output tray 11, and the sheets P are aligned when the recorded sheet P is not being conveyed to the output tray 11. However, the present invention is not limited to this configuration. For example, the sheets P may be aligned at any appropriate timing independently of the image quality mode.

In the above-described embodiment, the larger the number of sheets P stacked on the output tray 11 upon the preceding alignment of the sheets P, the smaller the value of the first predetermined number is determined, but the present invention is not limited to this configuration. For example, the printer may be configured such that the first predetermined number is fixed, and the larger the number of sheets P stacked on the output tray 11, the larger external force is applied to the sheets P by the alignment mechanism 30. Also, the alignment mechanism 30 may be controlled independently of the number of sheets P stacked on the output tray 11.

While the number of sheets P stacked on the output tray 11 are obtained by the optical sensor in the form of the number-of-stacked-sheets obtaining sensor 12 in the above-described embodiment, the present invention is not limited to this configuration. For example, the number of sheets P stacked on the output tray 11 may be obtained by a sensor for sensing a weight of the sheets P stacked on the output tray 11. Also, the controller 100 may have software serving as a counter configured to count the cumulative total of the number of sheets P conveyed to the output tray 11 to obtain the number of sheets P stacked on the output tray 11.

While the sheets P are aligned by the mechanical external force such as collision and vibration in the above-described embodiment, the alignment mechanism 30 may be controlled to align the stacked sheets P by applying an external force such as air and pressure to the stacked sheets P.

While the controller 100 is configured by the single CPU in the above-described embodiment, the controller 100 may be configured by a plurality of CPUs, an application-specific integrated circuit (ASIC), or a combination of the CPU(s) and the ASIC.

What is claimed is:

1. An image recording apparatus comprising:

a recording unit configured to record an image on a recording medium;

a storage configured to store a recording job containing image data representative of a plurality of images to be recorded on a plurality of recording media by the recording unit;

a tray configured to support the recording medium on which an image has been recorded by the recording unit;

a conveyor mechanism configured to convey, to the tray, the recording medium on which the image has been recorded by the recording unit;

an alignment mechanism configured to align a plurality of recording media stacked on the tray, by application of an external force; and a controller configured to control the recording unit, the conveyor mechanism, and the alignment mechanism, the controller being configured to control the recording unit to record the plurality of images respectively on a plurality of recording media based on the image data contained in the recording job stored in the storage, the controller being configured to control the conveyor mechanism to convey, to the tray, the plurality of recording media on which the plurality of images have been respectively recorded by the recording unit, in a period from a start to an end of recording based on one recording job, the controller being configured to control the alignment mechanism to align the plurality of recording media stacked on the tray in a period in which image recording is not performed by the recording unit and control the alignment mechanism not to align the plurality of recording media stacked on the tray in a period in which image recording is being performed by the recording unit.

2. The image recording apparatus according to claim 1, wherein the controller is configured to control the recording unit and the alignment mechanism such that the alignment mechanism aligns the plurality of recording media stacked on the tray when the number of recording media conveyed by the conveyor mechanism after a preceding alignment performed by the alignment mechanism has reached a first number.

3. The image recording apparatus according to claim 2, wherein in a case where the number of recording media to be recorded after the preceding alignment performed by the alignment mechanism in the period of the recording based on the one recording job is greater than the first number and less than a second number which is greater than the first number, the controller controls the recording unit and the alignment mechanism such that the alignment mechanism does not align the plurality of recording media stacked on the tray when the number of recording media stacked on the tray after the preceding alignment performed by the alignment mechanism has reached the first number and such that the alignment mechanism aligns the plurality of recording media stacked on the tray after the recording unit has finished recording the plurality of images respectively on the plurality of recording media based on the one recording job.

4. The image recording apparatus according to claim 2, further comprising a stacked-sheet-number obtainer configured to obtain the number of recording media stacked on the tray, wherein the larger the number of recording media which is obtained by the stacked-sheet-number obtainer, the smaller the first number is determined.

5. The image recording apparatus according to claim 1, wherein the controller is configured to determine whether recording on the plurality of recording media by the recording unit based on the one recording job is interrupted by a predetermined cause, and wherein the controller is configured to, when the controller has determined that the recording on the plurality of recording media by the recording unit based on the one recording job is interrupted by the predetermined cause, control the recording unit and the alignment mechanism such that the alignment mechanism aligns the plurality of recording media stacked on the tray in an interruption period over which the recording on the plurality of recording media by the recording unit based on the one recording job is interrupted.

6. The image recording apparatus according to claim 5, wherein the controller is configured to, when the controller has determined that the recording on the plurality of recording media by the recording unit based on the one recording job is interrupted by a cause that differs from the predetermined cause, control the recording unit and the alignment mechanism such that the alignment mechanism does not align the plurality of recording media stacked on the tray in a period over which the recording on the plurality of recording media by the recording unit based on the one recording job is interrupted by the cause that differs from the predetermined cause.

7. The image recording apparatus according to claim 5, wherein the controller is configured to, when the recording on the plurality of recording media by the recording unit based on the one recording job is interrupted by at least one of running out of recording media, running out of liquid to be ejected from the recording unit, a need of drying a recording media on which an image has been recorded, and a full tray of recording media, control the recording unit and the alignment mechanism such that the alignment mechanism aligns the plurality of recording media stacked on the tray.

8. The image recording apparatus according to claim 1, wherein the recording unit comprises; a recording head with an injection face having at least one injection opening from which the recording head injects liquid to record an image; and a maintenance mechanism contactable with the ejection face to perform maintenance on the recording head, and wherein the controller is configured to control the maintenance mechanism and the alignment mechanism such that the alignment mechanism does not align the plurality of recording media stacked on the tray, when the controller controls the maintenance mechanism to perform the maintenance in an interruption period over which recording on the plurality of recording media by the recording unit for the one recording job is interrupted.

9. The image recording apparatus according to claim 1, wherein the recording unit comprises: a recording head with an ejection face having at least one ejection opening from which the recording head ejects liquid to record an image, wherein the conveyor mechanism is configured to convey the recording medium to the tray via an opposite area that is opposite the ejection face, wherein the image recording apparatus further comprises a jam sensor configured to sense a jam of a recording medium at the opposite area, and wherein the controller is configured to, when the jam is sensed by the jam sensor, control the alignment mechanism not to align the plurality of recording media stacked on the tray.

10. The image recording apparatus according to claim 1, wherein the tray is disposed above the recording unit.

11. The image recording apparatus according to claim 1, wherein the recording unit is configured to record an image on a recording medium in one of a first image quality mode and a second image quality mode in which the recording unit records an image at higher image quality than in the first image quality mode, and wherein, in a case where the recording unit records the plurality of images respectively on the plurality of recording media based on the one recording job in the second image quality mode, the controller controls the alignment mechanism to align the plurality of recording media stacked on the tray not when a recording medium is being conveyed by the conveyor mechanism but when a recording medium is not being conveyed by the conveyor mechanism in the period of the recording based on the one recording job.

12. The image recording apparatus according to claim 1, further comprising a stacked-sheet-number obtainer configured to obtain the number of recording media stacked on the tray, wherein the controller is configured to increase the external force to be applied by the alignment mechanism, with increase in the number of recording media which is obtained by the stacked-sheet-number obtainer.

13. The image recording apparatus according to claim 1, wherein the tray comprises: a support face that inclines with respect to a horizontal plane; and an abutment member provided on a lower edge portion of the support face, wherein one edges of a plurality of recording media abut the abutment member, and wherein the alignment mechanism is configured to vibrate the tray to align the plurality of recording media being in abutment against the abutment member.

14. The image recording apparatus according to claim 1, wherein the alignment mechanism comprises: a pair of limiting walls arranged parallel to each other to limit opposite edge portions of the plurality of recording media stacked on the tray; and a limiting-wall displacement mechanism configured to displace at least one of the pair of limiting walls to change a distance between the pair of limiting walls, and wherein the alignment mechanism is configured to cause the limiting-wall displacement mechanism to displace the at least one of the pair of limiting walls to align the opposite edge portions of the plurality of recording media stacked on the tray.

15. A method of aligning a plurality of recording media which is executed by a processor of an image recording apparatus, the image recording apparatus comprising: a recording unit configured to record an image on a recording medium; a storage configured to store a recording job containing image data representative of a plurality of images to be recorded on a plurality of recording media by the recording unit; a tray configured to support the recording medium on which an image has been recorded by the recording unit; a conveyor mechanism configured to convey, to the tray, the recording medium on which the image has been recorded by the recording unit; and an alignment mechanism configured to align a plurality of recording media stacked on the tray, by application of an external force, the method comprising:

causing the recording unit to record the plurality of images respectively on a plurality of recording media based on the image data contained in the recording job stored in the storage;

causing the conveyor mechanism to convey, to the tray, the plurality of recording media on which the plurality of images have been respectively recorded by the recording unit; and in a period from a start to an end of recording based on one recording job, causing the alignment mechanism to align the plurality of recording media stacked on the tray in a period in which image recording is not performed by the recording unit and controlling the alignment mechanism not to align the plurality of recording media stacked on the tray in a period in which image recording is being performed by the recording unit.

16. A non-transitory storage medium storing a plurality of instructions readable by a computer of an image recording apparatus, the image recording apparatus comprising: a recording unit configured to record an image on a recording medium; a storage configured to store a recording job containing image data representative of a plurality of images to be recorded on a plurality of recording media by the recording unit; a tray configured to support the recording medium on which an image has been recorded by the recording unit; a conveyor mechanism configured to convey, to the tray, the recording medium on which the image has been recorded by the recording unit; and an alignment mechanism configured to align a plurality of recording media stacked on the tray, by application of an external force, the plurality of instructions, when executed by a processor of the image recording apparatus, causing the image recording apparatus to perform:

recording the plurality of images respectively on a plurality of recording media based on the image data contained in the recording job stored in the storage;

conveying, to the tray, the plurality of recording media on which the plurality of images have been respectively recorded by the recording unit; and in a period from a start to an end of recording based on one recording job, aligning the plurality of recording media stacked on the tray in a period in which image recording is not performed by the recording unit and controlling the alignment mechanism not to align the plurality of recording media stacked on the tray in a period in which image recording is being performed by the recording unit.

* * * * *